US009199207B1

(12) United States Patent
Sablak

(10) Patent No.: US 9,199,207 B1
(45) **Date of Patent: *Dec. 1, 2015**

(54) GAUGE WELL MIXER

(71) Applicant: Steven A. Sablak, Eagan, MN (US)

(72) Inventor: Steven A. Sablak, Eagan, MN (US)

(73) Assignee: Marathon Petroleum Company LP, Findlay, OH (US)

( * ) Notice: Subject to any disclaimer, the term of this patent is extended or adjusted under 35 U.S.C. 154(b) by 128 days.

This patent is subject to a terminal disclaimer.

(21) Appl. No.: 14/017,569

(22) Filed: Sep. 4, 2013

Related U.S. Application Data

(62) Division of application No. 12/589,055, filed on Oct. 16, 2009, now Pat. No. 8,579,139.

(51) Int. Cl.
*B01F 5/06* (2006.01)

(52) U.S. Cl.
CPC ..... *B01F 5/0679* (2013.01)

(58) Field of Classification Search
CPC ..... B65D 88/42
USPC ..... 220/216; 73/305, 319; 366/336, 340; 138/44
See application file for complete search history.

(56) References Cited

U.S. PATENT DOCUMENTS

| | | | | |
|---|---|---|---|---|
| 2,237,461 | A * | 4/1941 | Tokheim | 220/221 |
| 2,401,570 | A | 6/1946 | Koehler | |
| 2,740,616 | A * | 4/1956 | Walden | 366/336 |
| 3,167,305 | A | 1/1965 | Backx et al. | |
| 4,260,068 | A | 4/1981 | McCarthy et al. | |
| 4,308,968 | A | 1/1982 | Thiltgen et al. | |
| 4,468,975 | A | 9/1984 | Sayles et al. | |
| 5,138,891 | A | 8/1992 | Johnson | |
| 5,372,270 | A | 12/1994 | Rosenkrantz | |
| 5,423,446 | A | 6/1995 | Johnson | |
| 5,559,295 | A | 9/1996 | Sheryll | |
| 8,579,139 | B1 | 11/2013 | Sablak | |

OTHER PUBLICATIONS

Kenneth W. Mei, Chevron Research & Technology Co., Unslotted gauge wells cause tank-level measurement errors; Oil & Gas Journal, Jan. 30, 1995.

* cited by examiner

*Primary Examiner* — David Sorkin

(74) *Attorney, Agent, or Firm* — Emch, Schaffer, Schaub & Porcello Co., LPA

(57) ABSTRACT

This gauge well mixer works off of the differential pressure in a storage tank and gauge well. Slot covers with dividers are installed in the gauge well. The slot covers and dividers are staggered for better mixing. The gauge well has a vertical interior space extending the length of thereof; wherein the slots open into the vertical, interior space. A first horizontal divider is located in the vertical, interior space below a first slot; and a second horizontal divider is located in the vertical, interior space above a second slot. The slot covers are installed on slots located between the first slot and the second slot.

3 Claims, 4 Drawing Sheets

GAUGE WELL MIXER

CROSS REFERENCE TO RELATED APPLICATION

The present patent application is a divisional of and claims the benefit of U.S. patent application Ser. No. 12/589,055 filed Oct. 16, 2009.

TECHNICAL FIELD

This invention relates to a gauge well mixer. More specifically the invention relates to a storage tank having a gauge well that is perforated and extends through a floating roof for the tank.

BACKGROUND OF THE INVENTION

In connection with storage tanks or volatile products, the requirements for eliminating any vapor emissions have been found difficult where the tank has a floating roof and includes a perforated gauge well. The perforated gauge well may give us better mixing in the well but comprises vapor emissions. Therefore unslotted wells are used but reduce the mixing effect.

The lack of vapor seal caused by the foregoing indicated structure is overcome by the use of a seal structure.

Gauge well systems are known in the art. The systems for a gauge well typically are used in a liquid storage tank with a floating roof. Unslotted gauge wells especially are known to cause tank-level measurement errors. Slotted gauge wells have provided somewhat of an improvement. Unslotted gauge wells give a false level readings in multi-use tanks due to gravity differences.

SUMMARY OF THE INVENTION

This invention works off of the differential pressure in the tank and gauge well.

In this invention, slot covers with dividers are installed in the gauge well. The slot covers and dividers are staggered for better mixing.

When using a multi-purpose tank, the liquids can layer in the gauge tube. For example, gasoline and 12 lb. natural gasoline have different gravities. By using a slotted tube, the products will mix but air quality standards will be compromised. This invention uses connected slots and product head pressure for better mixing. This allows the product at higher pressure to relieve through a lower slot and return through another higher slot at lower pressure, therefore self-mixing the gauge tube.

This mixing provides an accurate example of the liquid mixture found in the rest of the tank, yet still complying with air quality standards.

Other objects and advantages of the present invention will become apparent to those skilled in the art upon a review of the following detailed description of the preferred embodiments and the accompanying drawings.

DETAILED DESCRIPTION OF THE INVENTION

This gauge well mixer works off of the differential pressure in a storage tank and gauge well. The gauge well has a vertical interior space extending the length of thereof; wherein the slots open into the vertical, interior space. A first horizontal divider is located in the vertical interior space the gauge well, below a first slot; and a second horizontal divider is located in the vertical, interior space above a second slot. The slot covers are installed on the exterior of the gauge well over slots located between the first slot and the second slot.

Figure 1:
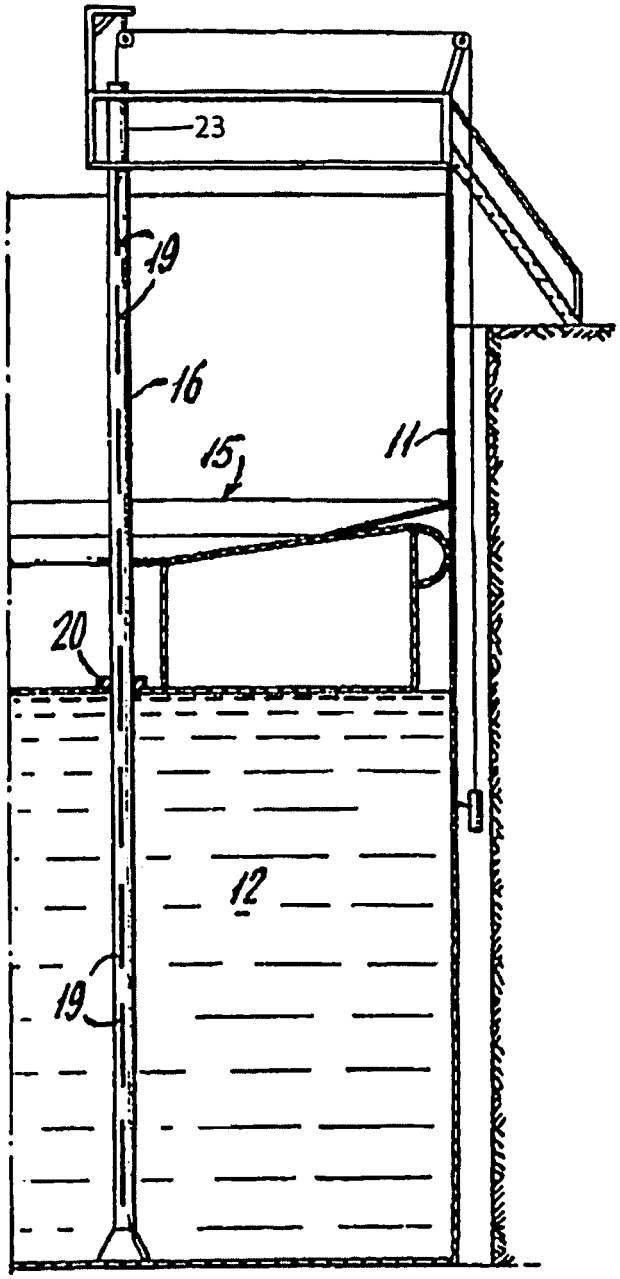
FIG. 1 is a fragmentary schematic showing a cross-section of a floating roof type tank with a gauge well therein.

FIG. 1 shows a storage tank 11 that holds a quantity of volatile product 12 therein. There is a floating roof 15 which rests on the product 12 and which is in contact with the product 12 adjacent to a gauging well 16. Gauging well 16 is firmly attached to the storage tank 11 at the bottom, and it has a plurality of perforation slots 19. The slots are spaced apart along the length of the gauging well 16.

There is a vapor tight seal 20 that is mounted on the roof 15 at the lower surface thereof which rests on the product 12. The seal 20 surrounds the outside of the gauging well 16, and of course the seal moves with the roof 15 as the level of the product changes.

Also shown is inlet fill nozzle 22, finished product 24 and overflow vent 26.

Figure 2:
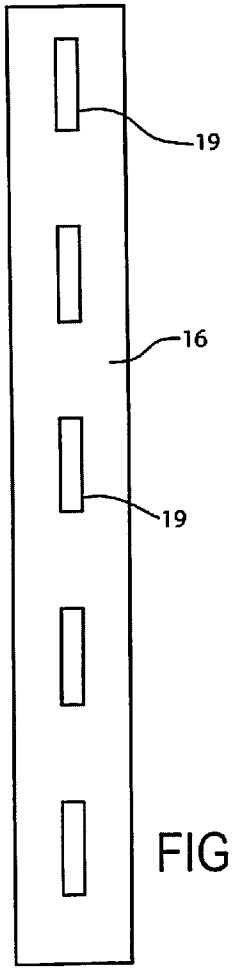
FIG. 2 is a perspective view of a gauge well with slots/holes installed.

FIG. 2 is a perspective view of a gauge well with slots/holes installed. FIG. 2 shows gauging well 16 and perforated slots 19 in greater detail.

Figure 3:
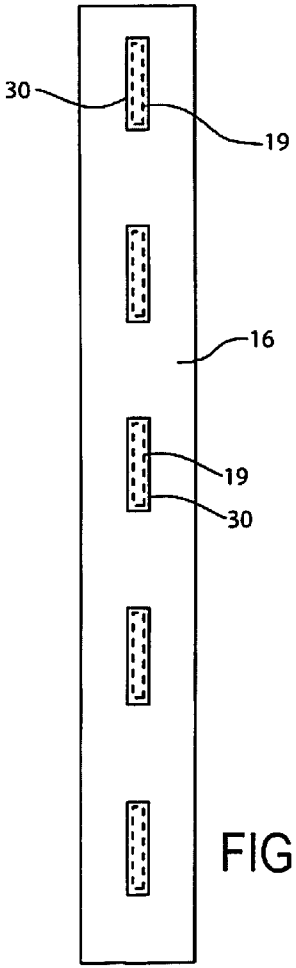
FIG. 3 is a perspective view of a slot cover with dividers.

FIG. 3 is a perspective view of the slot covers of this invention. FIG. 3 shows slot covers 30 blocking slots 19. As will be shown, multiple arrangements of covers 30 may be used in carrying out this invention.

Figure 4:
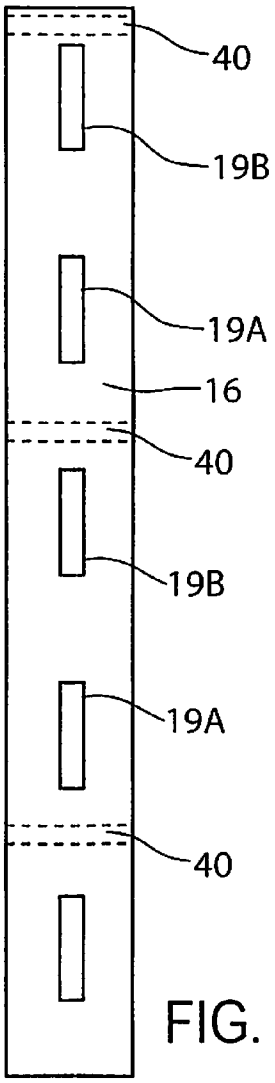
FIG. 4 is a perspective view of a gauge tube with slot cover installed.

FIG. 4 is a perspective view of a gauge tube with dividers installed. FIG. 4 shows dividers 40 installed in gauging well 16. Dividers 40 are installed between slots 19A and 19B. As will be shown multiple arrangements of dividers 40 may be used in carrying out this invention.

Figure 6:
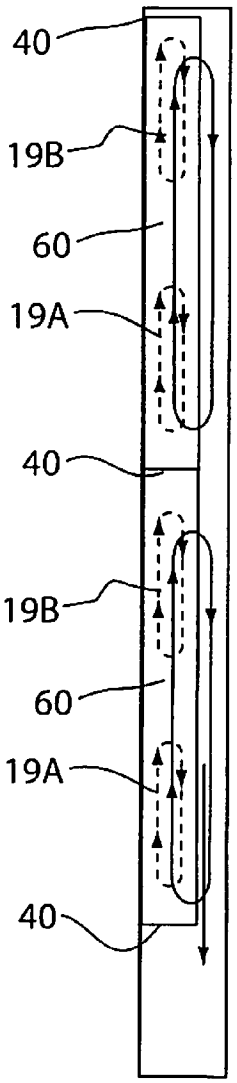
FIGS. 5 and 6 are schematic views of gauge well mixing zones which result when covers are installed and slot covers are staggered for better mix.
Figure 5:
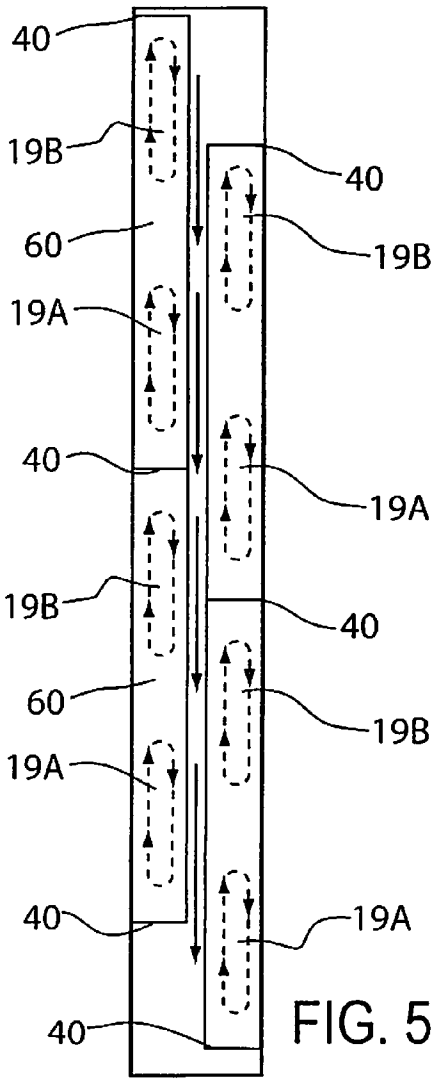

FIGS. 5 and 6 are schematic views of gauge well mixing zones 60 which result when covers 30 and dividers 40 are installed and staggered for better mix. For example, slot covers 30 are block slots 19 located between any two dividers 40. For example, first divider 40 may be located above fourth slot 19 and below third slot 19. Covers 30 are installed over fourth and third slots 19. In this manner, circulation (stirring) will occur between third slot 19 and fourth slot 19.

Shown are a plurality of mixing zones 50 staggered for better mix. At a minimum, a mixing zone 50 includes one pair of dividers 40. Sandwiched between the pair of dividers 40 are two (2) slots 19.

Figure 7:
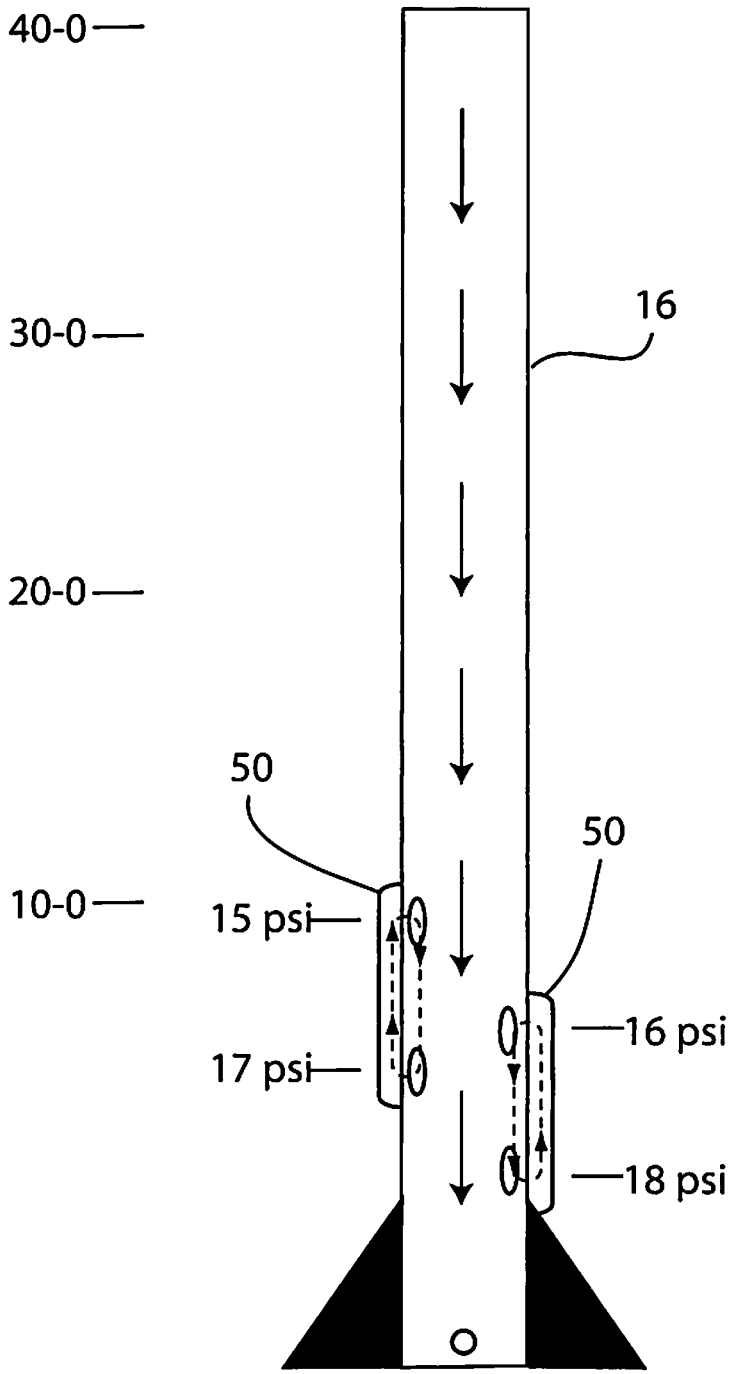
FIG. 7 shows the high and low pressures in a mixing zone.

FIG. 7 shows the high and low pressure in typical mixing zones 50. In one zone 50 the low pressure is 15 psi and the high pressure is 17 psi. In another zone 50, the low pressure is 16 psi and the high pressure is 18 psi.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. An apparatus comprising a gauge well mixer located in a storage tank having a floating roof:

wherein the gauge well mixer is configured to work off of the differential pressure in the storage tank and the gauge well mixer;

the gauge well mixer being attached to the storage tank and having slots extending along the length thereof;

the floating roof resting on a liquid stock;

the gauge well mixer having a seal between the floating roof and the outside of the mixer;

the gauge well mixer extending above the maximum level of the liquid stock;

the gauge well mixer having a vertical interior space extending the length of thereof;

wherein a plurality of slots open into the vertical, interior space;

a first horizontal divider located in the vertical, interior space below a first slot;

a second horizontal divider located in the vertical, interior space above a second slot;

slot covers installed on slots located between the first slot and the second slot; and wherein the first horizontal divider, the second horizontal divider and the slot covers form a mixing zone in the vertical interior space between the first horizontal divider and the second horizontal divider.

2. An apparatus according to claim 1 wherein a plurality of horizontal dividers and a plurality of slot covers are arranged to form a plurality of mixing zones.

3. An apparatus according to claim 2 wherein the slot covers and dividers are staggered for better mixing.

* * * * *